US007278442B2

(12) United States Patent
Holland et al.

(10) Patent No.: US 7,278,442 B2
(45) Date of Patent: Oct. 9, 2007

(54) VENTED PORT-CAP FOR FIRE HYDRANT

(76) Inventors: Darryll Arthur Douglas Holland, 15 Riverside Drive West, Elmira, Ontario (CA) N3B 1R2; Sean Kellie Montgomery, 173 Schneller Drive, Baden, Ontario (CA) N3A 2K9

( * ) Notice: Subject to any disclaimer, the term of this patent is extended or adjusted under 35 U.S.C. 154(b) by 31 days.

(21) Appl. No.: 11/214,715

(22) Filed: Aug. 31, 2005

(65) Prior Publication Data

US 2006/0042693 A1 Mar. 2, 2006

(30) Foreign Application Priority Data

Sep. 1, 2004 (GB) ..... 0419386.8

(51) Int. Cl.
*E03B 9/02* (2006.01)

(52) U.S. Cl. ..... 137/296; 137/107; 137/302; 137/15.19

(58) Field of Classification Search ..... 137/296, 137/272, 283, 533.11, 535, 539, 540, 107, 137/302, 15.18, 15.19
See application file for complete search history.

(56) References Cited

U.S. PATENT DOCUMENTS 1,828,763 A * 10/1931 Carnes ..... 137/107
2,489,787 A * 11/1949 Knowlton ..... 137/539
3,566,905 A 3/1971 Noland
3,581,761 A 6/1971 Noland
3,850,190 A * 11/1974 Carlson ..... 137/218
3,980,097 A 9/1976 Ellis
3,983,899 A 10/1976 Graham et al.
4,083,377 A 4/1978 Luckenbill
4,127,142 A 11/1978 Snider
4,141,574 A 2/1979 Stansifer et al.
4,154,259 A 5/1979 Ellis et al.
4,227,544 A 10/1980 Luckenbill
5,368,064 A 11/1994 Kjaer
5,441,074 A 8/1995 Kjaer
5,509,437 A 4/1996 Merrett
5,797,421 A 8/1998 Merrett
6,173,739 B1 1/2001 Addo et al.
6,382,875 B1 * 5/2002 Plumettaz ..... 405/184.2
6,561,214 B2 * 5/2003 Heil ..... 137/307
6,910,495 B2 * 6/2005 Lafalce ..... 137/218
2002/0144731 A1 10/2002 Heil
2005/0067016 A1 3/2005 Wigzell

FOREIGN PATENT DOCUMENTS

EP 0 463 702 1/1992

* cited by examiner

*Primary Examiner*—Kevin Lee
(74) *Attorney, Agent, or Firm*—Anthony Asquith Corp.

(57) ABSTRACT

The vented port-cap includes a check-valve, which admits air into the barrel of the hydrant when the pressure inside is lower than the pressure outside. After an inspection of the hydrant, the hydrant can be left to drain by itself, even though the port-cap has been replaced and tightened.

15 Claims, 5 Drawing Sheets

VENTED PORT-CAP FOR FIRE HYDRANT

This invention relates to the routine task of servicing and inspecting fire-hydrants, and provides a vented port-cap which aids the inspector in carrying out that task more efficiently. The invention is concerned with cold-climate dry-barrel hydrants, being hydrants of the kind in which water drains out of the barrel of the hydrant, after use, to a level below the frost-line in the surrounding ground.

BACKGROUND TO THE INVENTION

When inspecting a fire-hydrant, the main task of the inspector is to operate the hydrant to check that the water flow is adequate. After the test, the barrel of the hydrant is now full of water. The operator cannot just screw the port-cap back on, as that would prevent the water in the barrel from draining away.

So the operator has to waste time waiting for the barrel to drain, which can take twenty or thirty minutes, before he can screw the port-cap back on.

The invention is aimed at enabling the hydrant to drain by itself, so the operator can walk away from the hydrant immediately after the test.

GENERAL FEATURES OF THE INVENTION

One aspect of the invention lies in a port-cap, which preferably:

- includes an air-hole, which, when the port-cap is fastened to the hose-port, connects the interior of the barrel of the fire-hydrant to the outside atmosphere;
- includes a check-valve, which opens the air-hole when the atmospheric pressure outside the fire-hydrant exceeds the pressure inside the barrel of the fire-hydrant;
- and which closes the air-hole when the pressure inside the barrel exceeds the pressure outside.

BRIEF DESCRIPTION OF THE DRAWINGS

By way of further explanation of the invention, exemplary embodiments of the invention will now be described with reference to the accompanying drawings, in which.

DETAILED DESCRIPTION OF PREFERRED EMBODIMENTS

The apparatuses shown in the accompanying drawings and described below are examples. It should be noted that the scope of the invention is defined by the accompanying claims, and not necessarily by specific features of exemplary embodiments.

Figure 1:
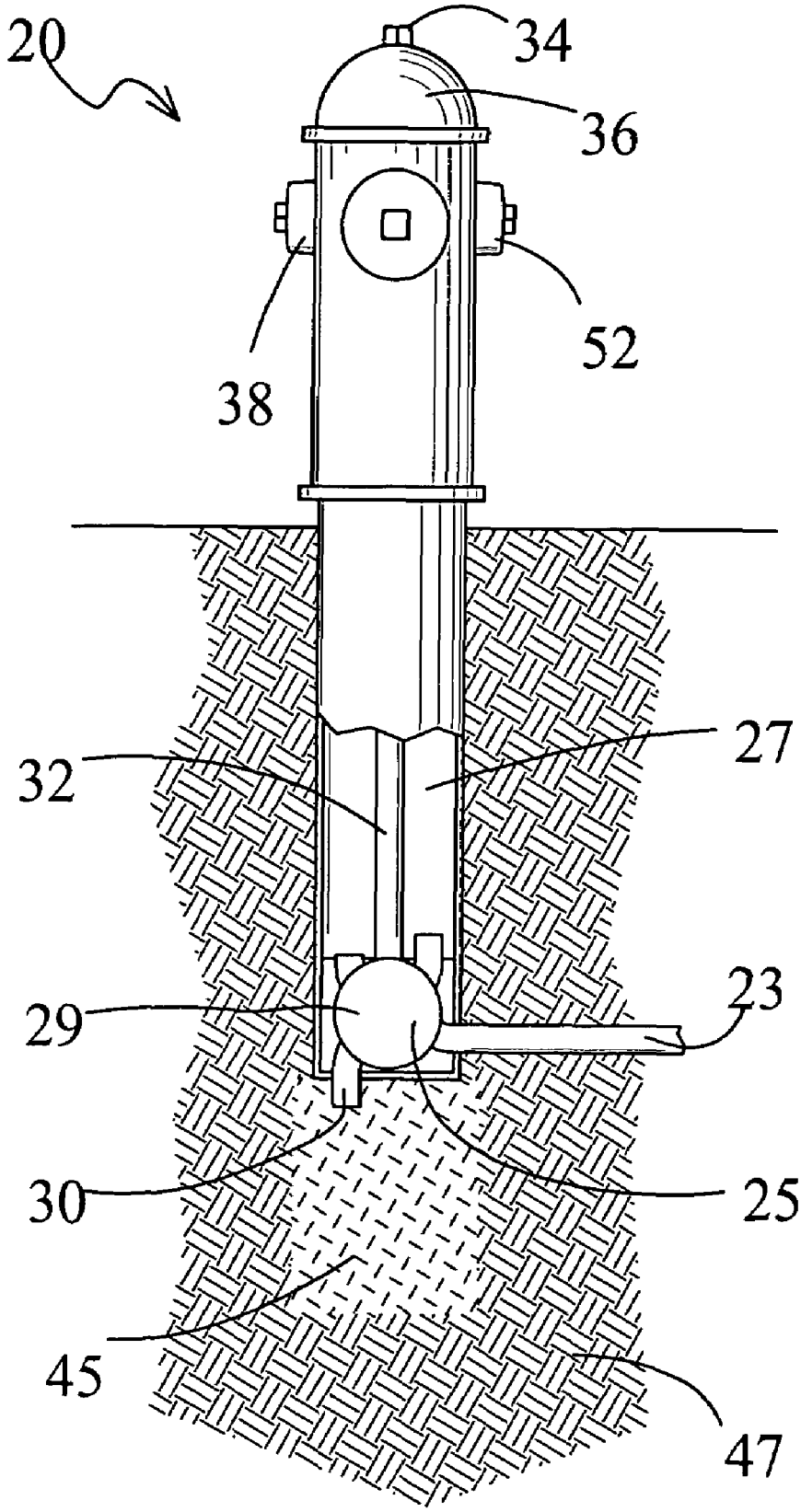
FIG. 1 is a diagrammatic view of a fire-hydrant.

A typical dry-barrel fire hydrant 20 is shown diagrammatically in FIG. 1. The hydrant is supplied with water from a city water main 23. At the bottom of the hydrant, there are two valves; one valve 25 connects the interior chamber or barrel 27 of the hydrant 20 to the water main 23, and the other valve 29 connects the interior chamber or barrel 27 to a drain 30. The valves 25, 29 are inter-connected, whereby when one is open the other is closed. Typically, the valves 25, 29 are combined mechanically in a unitary structure.

The valves 25, 29 are operated by rotating the operating rod 32. A squared end 34 of the rod 32 protrudes from the top dome 36 of the hydrant, and firefighters carry a standard wrench which fits over the squared end 34. When the rod 32 is turned one way, the barrel 27 is connected to the water main 23 and the drain 30 is closed; when the rod 32 is turned the other way, the water main 23 is closed and the barrel 27 is connected to drain 30.

In some types of hydrant, turning the rod 32 acts to screw a valve stem of the valves up/down, but again the effect is that when the drain 30 is open to the barrel 27 the main 23 is closed to the barrel 27 and vice versa.

Figure 2:
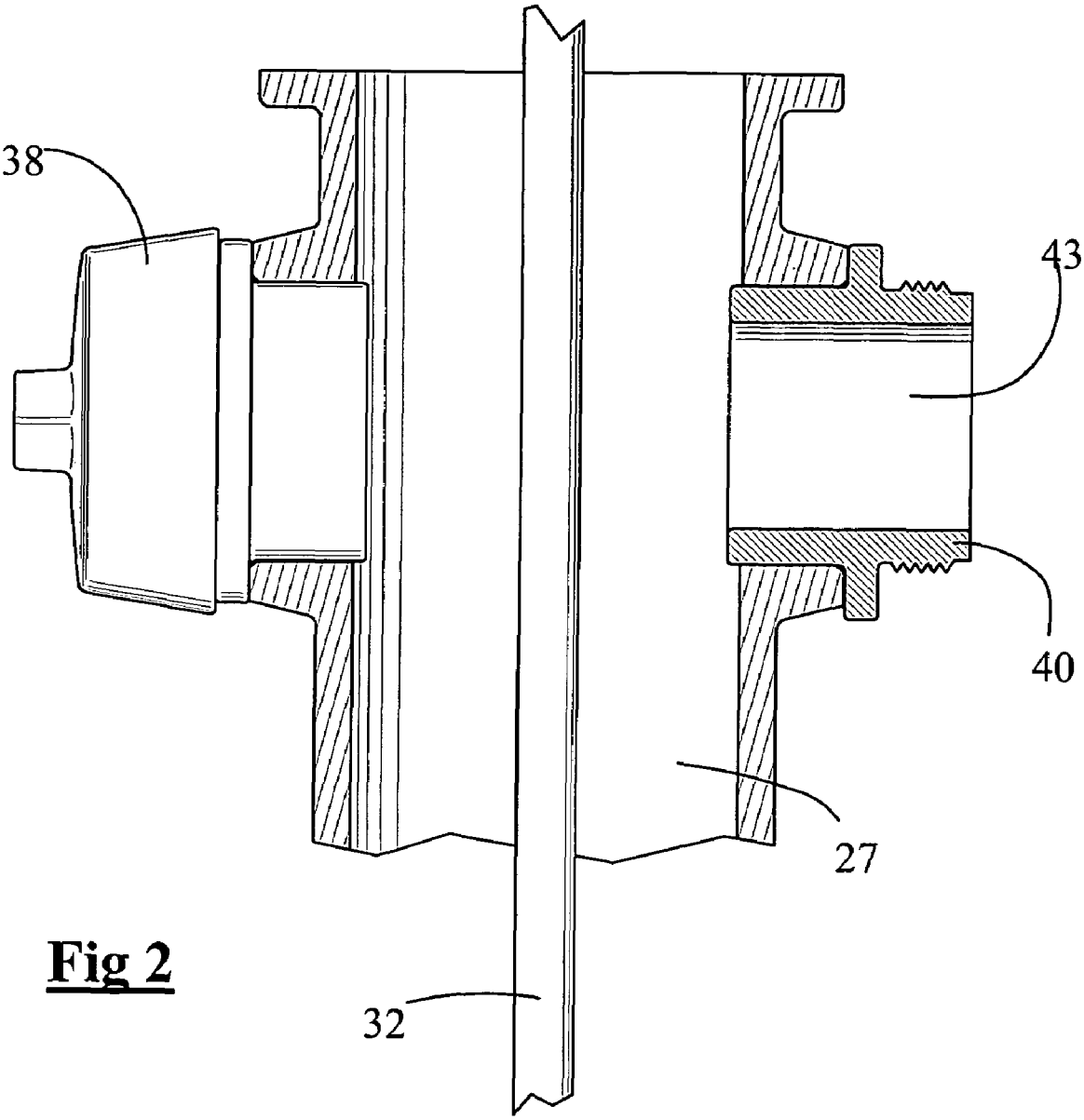
FIG. 2 is a close-up of the hose-port region of the hydrant of FIG. 1.

To couple a firehose to the hydrant 20, the firefighter uses the same wrench to remove one of the port-caps 38. The firehose can then be screwed onto the exposed threaded insert 40 of the open hose-port 43 (a standard 2½" hose-port being shown in FIG. 2). The insert 40, usually made of brass, is sealedly fastened into the body of the hydrant.

When first arriving at the scene, the firefighters screw one or more firehoses to the one or more hose-ports 43 of the hydrant. The remaining port-caps 38 must be left on, and be watertight, on any hose-ports that are not coupled to firehoses. When all the firehoses have been screwed tight, the firefighter turns the end 34 of the rod 32, thereby opening the water main and closing the drain. Thus, the barrel 27 fills with water, and then water flows out of the firehose.

After the use of the fire-hydrant, the water is shut off. Now, the barrel 27 is still full of water, and the water will be retained in the barrel, held up by atmospheric pressure, so long as the firehoses (and/or the port-caps) remain airtightly covering the hose-ports 43. When the firehoses are disconnected, the water can now drain out through the drain 30 at the bottom of the barrel. As shown, there is a soakaway 45 for the water from the barrel to drain into, and thence into the surrounding soil 47.

The main focus of the invention is not so much to improve the performance of the hydrant during an emergency, but rather to improve the efficiency with which the routine task of inspecting multiple fire hydrants can be done.

In many jurisdictions, the rule is that fire hydrants should be checked once a year. At the inspection, the inspector operates the rod 32, and makes sure the hydrant will operate properly if it should be needed in an emergency. The task of inspecting is done by full-time specialists, who inspect thousands of hydrants.

The inspection procedure for a dry-barrel hydrant typically includes the following elements.

1. The inspector unscrews and removes all the port-caps 38.
2. Then, the inspector operates the rod 32, and checks that a full flow of water issues from the hose-ports 43.
3. Then, the inspector turns the rod 32 the other way; this shuts off the main 23, and opens the drain 30.
4. Then, the inspector waits for the water to drain out of the barrel 27.
5. When all the water has drained out, the inspector replaces and tightens the port-caps 38.
6. Finally, the inspector logs that, on that date, the hydrant 20 has been inspected, operated, drained, and restored to a condition of readiness; and then moves on to the next one.

The time-wasting aspect of traditional hydrant inspection is that, after the water flow test, the inspector must wait for the water to drain out of the barrel. A dry-barrel hydrant, as used in cold climates, cannot be left full of water, but must be drained down to below the frost-line.

The inspector traditionally has had to leave at least one of the port-caps 38 off, i.e has had to refrain from screwing at least one port-cap back on, during the drainage phase. With the port-cap 38 left off, drainage of the barrel 27 of the hydrant after testing takes typically about twenty or thirty minutes. (This period might vary, depending on soil conditions, ground water table, condition of the drain, etc.) If all the port-caps were to be replaced before the water had drained, the undrained water would remain in the barrel more or less indefinitely, and would freeze in cold weather. Therefore, the inspector must not simply screw all the port-caps 38 back on immediately after the test, and then walk away, leaving the hydrant to drain by itself.

When hydrants are close enough together, the inspector can inspect several in a batch. In the time it takes for one hydrant to drain, the inspector can be seeing to another element of the inspection procedure at another one of the hydrants. However, given that hydrants are often pitched 100 meters or more apart, such batch inspection often does not offer much of an improvement in efficiency.

Figure 3:
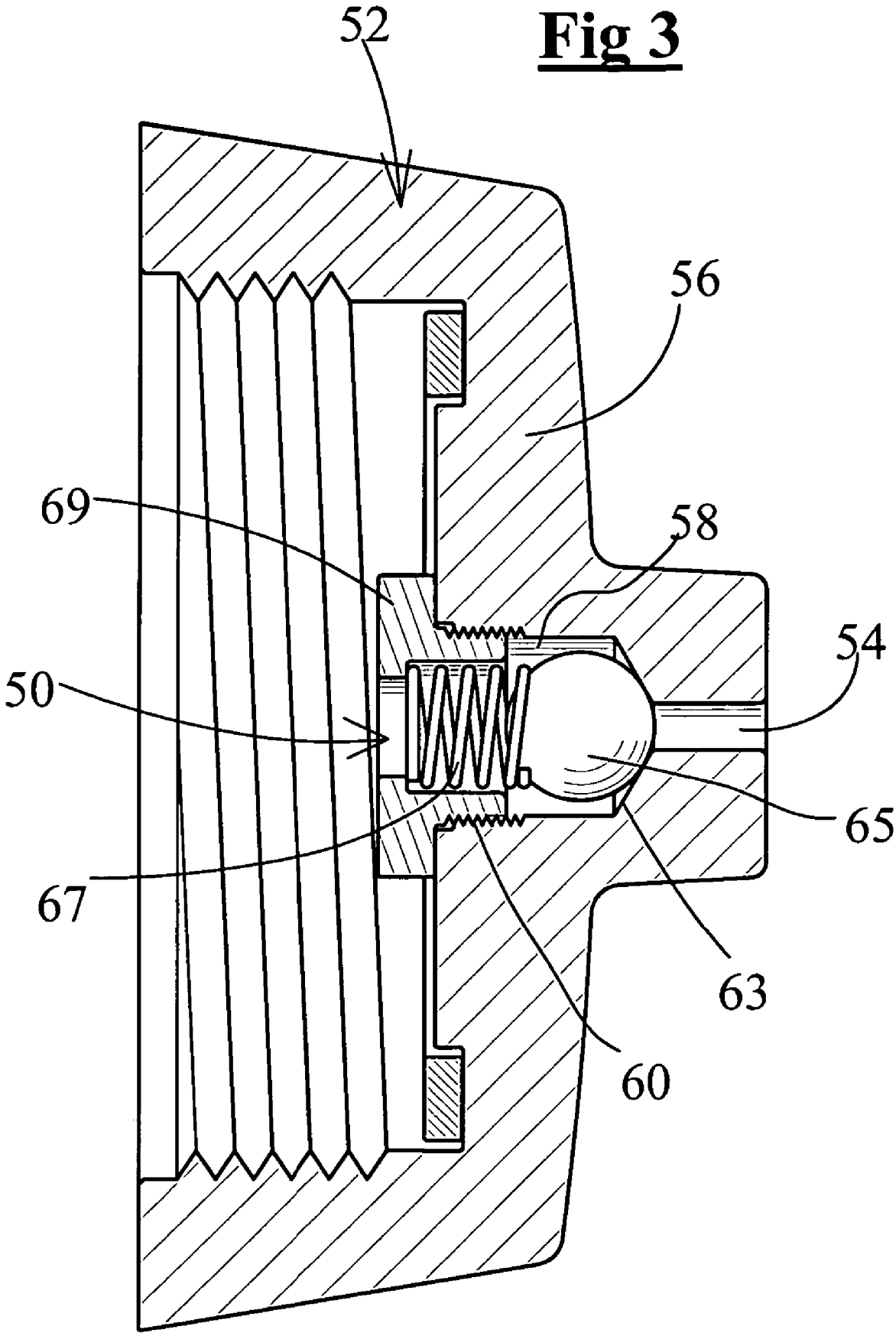
FIG. 3 is a cross-section of a port-cap of the hydrant.

The invention addresses this problem. The invention provides a check-valve 50 in one of the port-caps 52 (FIG. 3). The function of the check-valve 50 is to enable the inspector to replace all the port-caps at a hydrant immediately, and tighten them, and then to walk away from the hydrant, knowing that within half an hour or so the water will have drained out of the barrel.

Thus, the inspection procedure now may be modified. When the inspector has finished with the water test, they operate the rod 32 to close the main 23 and to open the drain 30, as before. But now, instead of waiting half an hour for the water to drain out, the inspector can replace every one of the port-caps 38,52, and immediately tighten them all to full watertightness.

As the water drains out of the barrel 27, air passes in through air-hole 54 of the port-cap 52, compensating and equalising the pressure inside the barrel, and preventing a vacuum from building up inside. In other words, water can drain out of the barrel 27 even though all the port-caps 38,52 have been replaced, and screwed watertight. Thus, the inspector now can walk away immediately after the test. They do not need to wait around for half an hour for the barrel to drain before replacing and tightening the port-caps.

Generally, the inspector cannot fail to hear the hiss of inrushing air through the air-hole 54; indeed, the absence of the audible hiss of air should alert the inspector to the possibility that the air-hole might be blocked. (It might also indicate that the drain port was plugged, indicating perhaps a need for more extensive repairs.)

In FIG. 3, the check-valve 50 has been incorporated into a standard port-cap body 56. The body 56 has been machined with a socket 58, which includes a screw-thread 60 and a ball-valve seating 63. Also, as mentioned, an air-hole 54 has been drilled through the body 56. A ball 65 and spring 67 are placed in the socket, and then plug 69 is screwed in.

Figure 4:
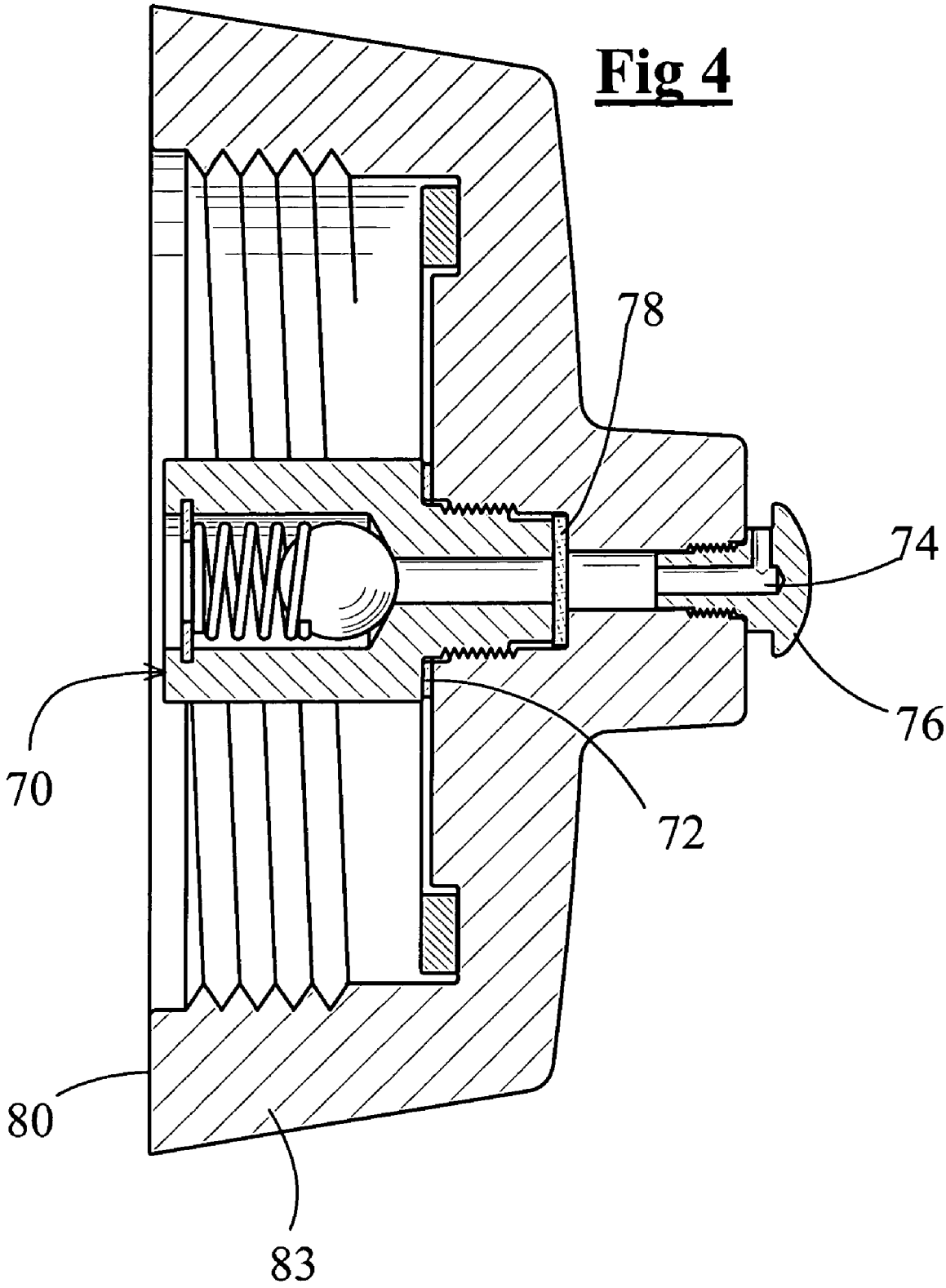
FIG. 4 is a cross-section, like that of FIG. 3, of an alternative port-cap.
Figure 5:
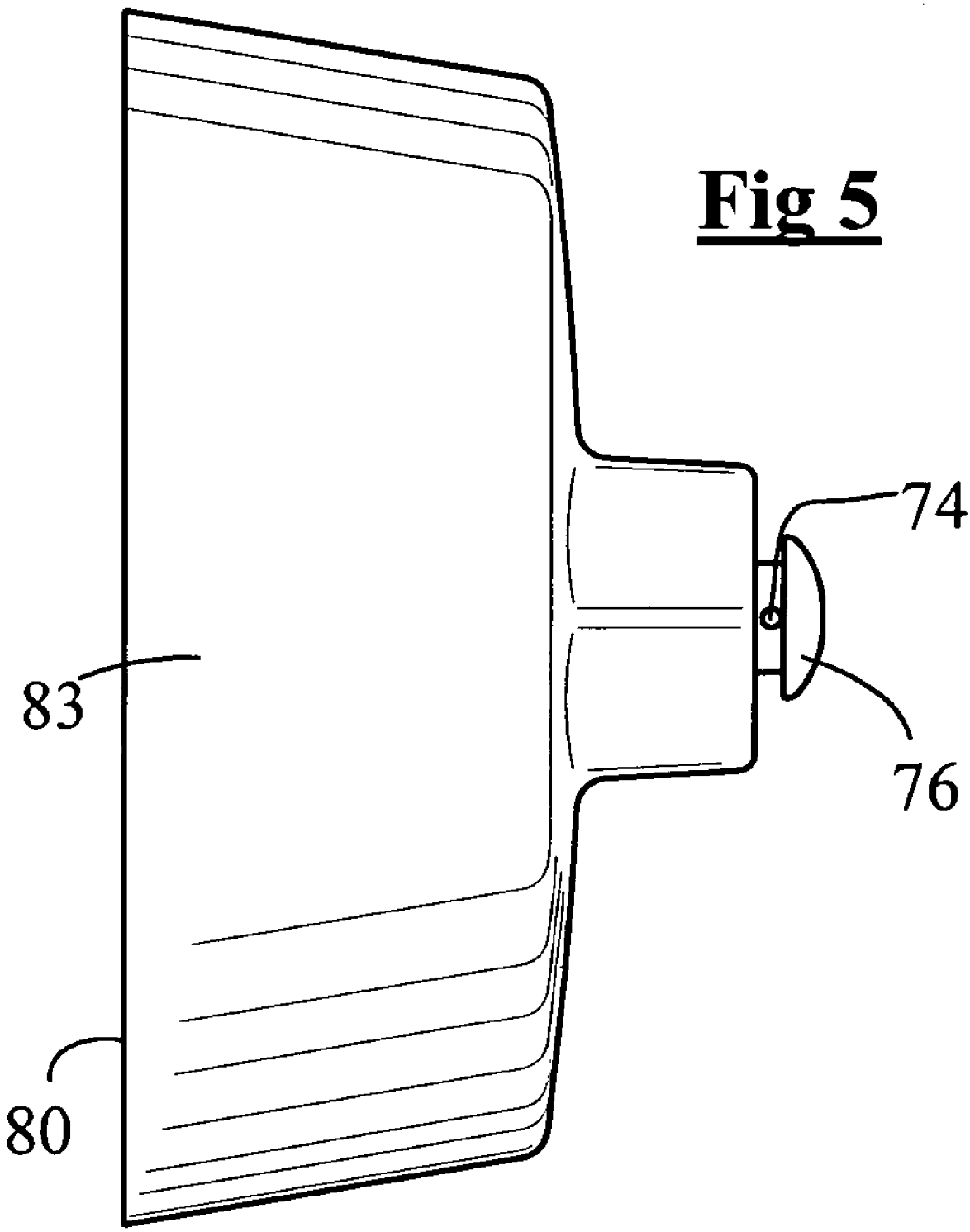
FIG. 5 is a side elevation of the port-cap of FIG. 4.

The version shown in FIG. 3 is simple and inexpensive, and needs no seal. Another version is shown in FIGS. 4, 5. Here, the check-valve 70 is provided as a sub-assembly. The check-valve components are demanding as to accuracy, surface-finish, material specification, pressure-rating, etc, whereby a purpose-made proprietary unit can be an advantage. However, when using the pre-made sub-assembly, an additional seal 72 is needed.

Also in FIGS. 4, 5, the air-hole 54 has been provided with an air-intake cap 76. It can happen that, if the air-hole 54 is left open (i.e uncapped, as in FIG. 3), vandals might amuse themselves by poking things into the air-hole. This does not matter in itself, i.e it does not matter if the air-hole becomes blocked up, and can no longer pass air, between inspections. The inspector can clean out the air-hole next inspection. So long as the air-hole remains clear for the half-hour after the inspection, that is all that is required.

Another danger is that the vandal might inadvertently (or deliberately) dislodge the ball 65 from its seat 63, leaving the check-valve held open; in an emergency, now, water might escape from the barrel of the hydrant, through the check-valve, and out through the air-hole. The air-intake cap 76 includes a tortuous air-path 74 inside the cap, which makes it very difficult for a vandal to unseat the ball in the check-valve. A filter screen 78 provides additional protection, to help keep the ball and seat clean and clear. It is advantageous if the tool required to remove the screwed-in air-intake cap is unusual, i.e one that a vandal is not likely to have to hand. Of course, it is not economically possible to guard against the vandal who is determined to sabotage the hydrant, and is prepared to carry the tools needed to do so.

The check-valve 50, 70 should be proof against whatever pressure might be present in the barrel 27 of the hydrant, during use. Hydrants themselves are designed to cater for the full water pressure available in the water main, plus a high safety factor. It is a simple matter to design and manufacture the check-valve, also, to be able to support a high internal pressure—say 2000 lbs/sq.in (psi). This pressure rating requirement is high enough that the check-valve components would have to be all metal (rather than e.g plastic). Of course, the metal should be of the kind that does not corrode in the fire-hydrant environment.

The check-valve 50, 70 is designed to open if the pressure inside the barrel of the hydrant falls below atmospheric pressure—as it does when the main valve 25 is closed and the drain valve 29 is open. As to the level of pressure at which the check-valve opens, good results have been obtained when the spring 67 is set to give a cracking pressure of around ½ psi. That is to say, the check-valve should be set to open at a pressure differential, in which the pressure inside the barrel is lower than the pressure outside, of more than ½ psi.

If the cracking pressure is set to more than about one psi, the valve would close too soon, i.e before all the water has drained out. If the cracking pressure were set to ¼ psi or less, the spring would have to be so light as possibly to compromise the operation of the check-valve; there is no place for delicacy in fire hydrants.

On the other hand, while it is beneficial, of course, for the valve to close properly and fully, it would not be calamitous if the valve were to remain slightly open. When the hydrant is being used to fight a fire, a little water escaping through a leaking check-valve would not be significant. Besides, the leak might wash away the debris, whereby the valve could then close.

As may be seen in FIGS. 3, 4, the structure of the check-valve 50, 70 does not project outside the end 80 of the skirt 83 of the port-cap body. This is important in keeping the check-valve from being damaged. It can happen that an inspector (or a firefighter) might drop the port-cap onto concrete from a height of a few feet; the skirt 83 being longer than the check-valve 50, 70 means that the valve structure is unlikely to be damaged when the port-cap is dropped.

Sometimes, port-caps are held captive on the hydrant by means of a short chain. While this is more to prevent the port-cap from being lost as to keep it from being damaged, if the designer wished to have the check-valve longer than the skirt, it might be prudent to do so only when the port-cap is chained to the hydrant.

It can happen that dry-barrel fire hydrants are located in areas where the water table might rise, whereby water backs up through the drain, and enters the barrel. If this happens, it is important that the water afterwards be drained out of the barrel. It will be understood that the presence of the check-valve in one of the port-caps, as described, automatically enables the barrel to drain in that circumstance.

The invention can be put into effect simply and inexpensively. The port-caps of fire-hydrants are so robust they are hardly ever damaged or broken, but inspectors generally carry a field-stock of standard port-caps, when out on the job, to replace lost ones. The inspector simply adds a supply of the modified port-caps to this field-stock. As mentioned, only one of the port-caps needs to have the air-hole and check-valve. Fire-hydrants generally have three hose-ports—two 2½" ports and one 4" port—and the other two can be left fully sealed.

The modification to the port-cap is carried out by machining the required air-hole and attachment socket in a standard port-cap, which is a simple and inexpensive in-factory operation. The inspector is not required to carry out any machining in the field; nor to carry out any task, in the field, that could be regarded as more demanding than simply replacing one of the port-caps of the hydrant with the modified version.

Another aspect of the invention lies in a procedure for modifying an existing fire hydrant. Here, a standard (solid) port-cap is modified by the addition of the air-hole, and is modified to receive the check-valve.

A further aspect of the invention lies in the modified, more efficient, inspection procedure made possible by the addition of the check-valve.

A further aspect includes the inspector listening for the audible hiss, and walking away responsively.

The invention claimed is:

1. Port-cap for a fire-hydrant, wherein:

the port-cap is so structured that the port-cap can be fastened to, and can close-off, a hose-port of a fire-hydrant;

the port-cap is so structured that the port-cap can be unfastened from, and removed from, the hose-port;

the port-cap includes an air-hole, which, when the port-cap is fastened to the hose-port, connects the interior of the barrel of the fire-hydrant to the outside atmosphere;

the port-cap includes a check-valve;

the check-valve is arranged in the port-cap to open the air-hole when the atmospheric pressure outside the fire-hydrant exceeds the pressure inside the barrel of the fire-hydrant;

the check-valve is arranged to close the air-hole when the pressure inside the barrel exceeds the pressure outside; and the port-cap includes an air-hole-cap, which is arranged to cover the air-hole in the port-cap.

2. Port-cap of claim 1, wherein:

the check-valve includes check-valve-components, being a ball, a ball-seating, a spring, and a check-valve body;

the check-valve body is arranged to hold the spring urged against the ball, and the ball thereby urged against the ball-seating; and the check-valve body is fast with the port-cap body.

3. Port-cap of claim 2, wherein:

the port-cap includes a port-cap body, having a hollow open-ended skirt-portion;

a female screw-thread is formed inside the skirt-portion, whereby the port-cap can be screwed onto a corresponding male screw-thread on the hose-port of the fire-hydrant; and all the check-valve-components are entirely contained within the skirt-portion of the port-cap.

4. Port-cap of claim 3, wherein all the check-valve-components are entirely contained within the skirt-portion of the port-cap, to the extent that, when the port-cap is viewed in side elevation, no check-valve-component, nor any portion thereof, is visible protruding outside the skirt-portion.

5. Port-cap of claim 2, wherein the ball-seating is machined directly into the metal of the port-cap body.

6. Port-cap of claim 2, wherein:

the ball, the ball seating, the spring, and the check valve body are all of metal;

the ball-seating is machined directly into the metal of the check valve body; and the check-valve-components form a self-contained pre-assembled sub-assembly, having been pre-assembled before the check valve is made fast to the port-cap body.

7. Port-cap of claim 2, wherein the check-valve body is threaded, and is screwed to a corresponding thread in the port-cap body.

8. Port-cap of claim 1, wherein the check-valve is structured to open when the atmospheric pressure outside the fire-hydrant exceeds the pressure inside the barrel of the fire-hydrant by less than about one psi.

9. Port-cap of claim 1, wherein the check-valve is structured to open when the atmospheric pressure outside the fire-hydrant exceeds the pressure inside the barrel of the fire-hydrant by more than about ¼ psi.

10. Port-cap of claim 1, wherein, the air-hole-cap includes a tortuous air passage.

11. Apparatus including the port-cap of claim 1 in combination with a dry-barrel fire-hydrant.

12. Apparatus of claim 11, wherein:

the fire-hydrant includes a main-valve and a drain-valve; and the fire-hydrant includes a valve operator, for operating the hydrant between a main-valve-open/drain-valve-closed condition and a main-valve-closed/drain-valve-open condition.

13. Procedure for modifying a fire-hydrant having a port-cover, including removing the port-cover, and replacing same with a port-cap that falls within the scope of claim 1.

14. Procedure for inspecting a fire hydrant, being a fire hydrant that falls within the scope of claim 11, wherein:

an operator unscrews the port-cap from the hose-port of the fire-hydrant;

the operator then opens the fire-hydrant, and inspects the flow of water therefrom;

the operator then shuts off the flow of water from the fire-hydrant;

the operator then immediately replaces the port-cap, including screwing and tightening the port-cap back onto the hose-port;

whereby, as a volume of water drains from the barrel of the fire-hydrant, a compensating volume of air enters the barrel through the air-hole in the port-cap;

whereby the operator can walk away and leave the fire-hydrant to drain by itself, with the port-cap replaced.

15. Procedure of claim 14, wherein:

the operator, having replaced the port-cap, listens for the hissing sound of air entering the barrel through the air-hole; and responsively to having heard the hissing sound, the operator walks away and leaves the fire-hydrant to drain by itself, with the port-cap replaced.

* * * * *